US009000864B2

(12) United States Patent
Tanaka

(10) Patent No.: US 9,000,864 B2
(45) Date of Patent: Apr. 7, 2015

(54) DIRECTIONAL COUPLER

(71) Applicant: Murata Manufacturing Co., Ltd., Kyoto-fu (JP)

(72) Inventor: Akira Tanaka, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/251,875

(22) Filed: Apr. 14, 2014

(65) Prior Publication Data

US 2015/0002239 A1 Jan. 1, 2015

(30) Foreign Application Priority Data

Jun. 26, 2013 (JP) ..... 2013-133989

(51) Int. Cl.
*H01P 5/12* (2006.01)
*H01P 5/18* (2006.01)

(52) U.S. Cl.
CPC ..... *H01P 5/184* (2013.01)

(58) Field of Classification Search
CPC ..... H01P 1/184; H01P 5/184; H01P 5/185; H01P 5/186; H01P 5/187
USPC ..... 333/109, 112, 115, 116
See application file for complete search history.

(56) References Cited

U.S. PATENT DOCUMENTS 4,999,593 A * 3/1991 Anderson ..... 333/112
6,600,386 B1 7/2003 Lobl et al.
8,314,663 B2 * 11/2012 Tamaru et al. ..... 333/109
8,847,681 B2 * 9/2014 Namerikawa et al. ..... 330/126
2004/0263281 A1 12/2004 Podell

FOREIGN PATENT DOCUMENTS

DE 19915246 A1 8/2000
EP 2535979 A1 6/2012
JP H11220312 A1 8/1999
JP 2007181063 7/2007
JP 4533243 B2 9/2010

(Continued)

OTHER PUBLICATIONS

Gillick, Matthew, et al, A 12-36 MMIC 3dB Coplanar Waveguide Directional Coupler, Proceedings of the European Microwave Conference, Finland, Aug. 24-27, 1992, vol. 1, pp. 724-728.

(Continued)

*Primary Examiner* — Jeffrey Zweizig
(74) *Attorney, Agent, or Firm* — Pearne & Gordon LLP

(57) ABSTRACT

A directional coupler for use in a predetermined frequency band includes a laminate body including a laminate of a plurality of insulation layers, a first terminal through a fourth terminal disposed on a surface of the laminate body, a main line connected between the first terminal and the second terminal and disposed on the insulation layer, a first sub-line connected to the third terminal, electromagnetically coupled with the main line, and disposed on the insulation layer, a second sub-line connected to the fourth terminal, electromagnetically coupled with the main line, and disposed on the second sub-line, and a phase adjusting circuit connected between the first sub-line and the second sub-line and configured to cause a phase shift on a passing signal. The main line, the first sub-line and the second sub-line do not overlap each other in a plan view from a direction of lamination.

13 Claims, 19 Drawing Sheets

(56) References Cited

FOREIGN PATENT DOCUMENTS

| | | | |
|---|---|---|---|
| JP | 2013-005076 | A | 1/2013 |
| WO | 9919934 | A1 | 4/1999 |
| WO | 9933139 | A2 | 7/1999 |

OTHER PUBLICATIONS

European Search Report for EP 14158842 dated Nov. 27, 2014.

European Patent Office Communication Pursuant to Article 94(3) EPC for EP 14158842 dated Jan. 5, 2015.

* cited by examiner

DIRECTIONAL COUPLER

BACKGROUND OF THE INVENTION

1. Field of the Invention

The present invention relates to directional couplers and more specifically to a directional coupler for use in a radio communication apparatus that performs communications using a high-frequency signal.

2. Description of the Related Art

A directional coupler described in Japanese Unexamined Patent Application Publication No. 2013-5076 is available as a related art direction coupler. The directional coupler includes a main line and a sub-line, opposed to each other with an insulation layer interposed therebetween. In this way, the main line and the sub-line are electromagnetically coupled with each other while being also capacitively coupled with each other.

A disadvantage with the directional coupler described in Japanese Unexamined Patent Application Publication No. 2013-5076 is an insufficient directivity. The flow of a signal in an electromagnetic coupled state and a capacitively coupled state is described below. FIG. 16 through FIG. 18 illustrate the flow of the signals in the directional coupler.

An even mode is created in the electromagnetic coupled state, and an odd mode is created in the capacitively coupled state. As illustrated in FIG. 16, in the even mode, electromagnetic induction in the electromagnetic coupled state causes a signal Sig 2 to flow along the sub-line in the direction opposite to the direction of a signal Sig 1 flowing along the main line. As illustrated in FIG. 17 on the other hand, in the odd mode, an electric field caused generated by the capacitive coupling causes a signal Sig 3 to flow in the opposite direction to the direction of the signal Sig 1 along the sub-line and a signal Sig 4 to flow in the same direction as the direction of the signal Sig 1 along the sub-line. As described above, the main line and the sub-line are electromagnetically coupled while also being capacitively coupled. As a result, part of the signal Sig 2 cancels out the signal Sig 4 as illustrated in FIG. 18. A signal Sig 5 generated when the part of the signal Sig 2 cancels out the signal Sig 4 flows along the sub-line in the opposite direction to the direction of the signal Sig 1. The directional coupler is based on the assumption that no signal is output at a terminal of the sub-line to which the signal Sig 4 flows and that a signal is output at a terminal of the sub-line to which the signals Sig 3 and Sig 5 flow. The characteristics that the sub-line of the directional coupler outputs a signal at only one of the two terminals thereof is referred to as directivity of the directional coupler. The directivity may be adjusted by adjusting the degree of electromagnetic coupling and capacitive coupling.

The directional coupler disclosed in Japanese Unexamined Patent Application Publication No. 2013-5076 includes the main line and the sub-line with the planes thereof opposed to each other and has a high degree of capacitive coupling. As a result, the odd mode appears stronger than the even mode in the directional coupler. Since the signals Sig 3 and Sig 4 flow in opposite directions in the odd mode, a desired directivity is difficult to achieve if the odd mode appears stronger than the even mode. The directional coupler disclosed in Japanese Unexamined Patent Application Publication No. 2013-5076 thus suffers from an insufficient directivity.

BRIEF SUMMARY OF THE INVENTION

Accordingly, it is an object of the present invention to provide a directional coupler having a sufficient directivity.

According to preferred embodiments of the present invention, a directional coupler for use in a predetermined frequency band includes a laminate body including a laminate of a plurality of insulation layers, a first terminal through a fourth terminal disposed on a surface of the laminate body, a main line connected between the first terminal and the second terminal and disposed on the insulation layer, a first sub-line connected to the third terminal, electromagnetically coupled with the main line, and disposed on the insulation layer, a second sub-line connected to the fourth terminal, electromagnetically coupled with the main line, and disposed on the second sub-line, and a phase adjusting circuit connected between the first sub-line and the second sub-line and configured to cause a phase shift on a passing signal. The main line, the first sub-line and the second sub-line do not overlap each other in a plan view from a direction of lamination.

The embodiments of the present embodiment may provide a directional coupler with an improved directivity.

Other features, elements, characteristics and advantages of the present invention will become more apparent from the following detailed description of preferred embodiments of the present invention with reference to the attached drawings.

DETAILED DESCRIPTION OF THE PREFERRED EMBODIMENTS

Directional couplers according to embodiments of the present invention are described below.

First Embodiment

Figure 1:
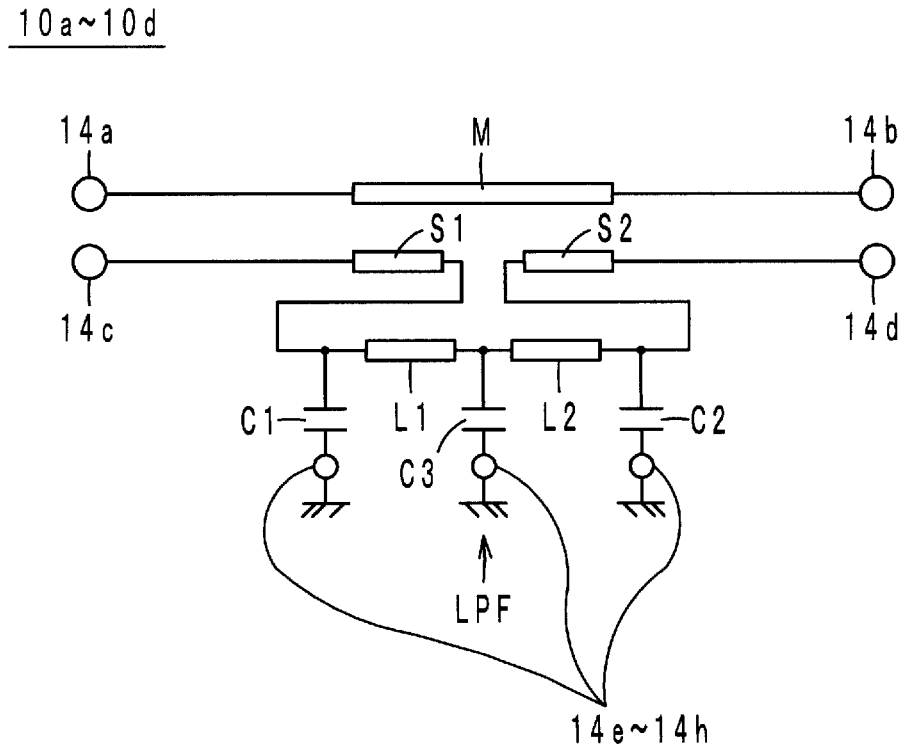
FIG. 1 is an equivalent circuit diagram of directional couplers according to first through fourth embodiments of the present invention.

A directional coupler of a first embodiment is described below with reference to the drawings. FIG. 1 is an equivalent circuit diagram of directional couplers 10*a* through 10*d* according to first through fourth embodiments.

The circuit of the directional coupler 10*a* is described below. The directional coupler 10*a* is used in a predetermined frequency band. For example, the predetermined frequency band is 824 MHz through 1910 MHZ if the directional coupler 10*a* receives a signal having a frequency bandwidth of 824 MHz through 915 MHZ (GSM800/900) and a signal having a frequency bandwidth of 1710 MHZ through 1910 MHz (GSM1800/1900).

The directional coupler 10*a* includes, as circuit elements, external electrodes (terminals) 14*a* through 14*h*, a main line M, sub-lines S1 and S2, and a low-pass filter LPF. The main line M is connected between the external electrodes 14*a* and 14*b*. The sub-line S1 is connected to the external electrode 14*c*, and is electromagnetically coupled with the main line M. The sub-line S2 is connected to the external electrode 14*d*, and is electromagnetically coupled with the main line M. The sub-line S1 and the sub-line S2 have the same line length.

The low-pass filter LPF is a phase adjusting circuit that is connected between the sub-line S1 and the sub-line S2. The low-pass filter causes in a passing signal a phase shift having an absolute value that increases monotonously within a range of about 0 degree or higher to about 180 degrees or lower as the passing signal is higher in frequency in the predetermined frequency band. The cutoff frequency of the low-pass filter LPF is not within the predetermined frequency band. In the first embodiment, the cutoff frequency of the low-pass filter LPF is spaced away from a predetermined frequency by 1 GHz or more. The low-pass filter LPF includes coils L1 and L2, and capacitors C1 through C3.

The coils L1 and L2 are connected in series between the sub-lines S1 and S2 and are not electromagnetically coupled with the main line M. The coil L1 is connected to the sub-line S1, and the coil L2 is connected to the sub-line S2.

The capacitor C1 is connected to one end of the coil L1. More specifically, the capacitor C1 is connected between the junction of the coil L1 and the sub-line S1, and external electrodes 14*e* through 14*h*. The capacitor C2 is connected to one end of the coil L2. The capacitor C2 is connected between the junction of the coil L2 and the sub-line S2, and the external electrodes 14*e* through 14*h*. The capacitor C3 is connected between the junction of the coil L1 and the coil L2 and the external electrodes 14*e* through 14*h*.

In the directional coupler 10*a* thus constructed, the external electrode 14*a* serves as an input port and the external electrode 14*b* serves as an output port. The external electrode 14*c* serves as a coupling port and the external electrode 14*d* serves as a termination port that is terminated with 50Ω. The external electrodes 14*e* through 14*h* serve as ground ports that are to be grounded. A signal, input to the external electrode 14*a*, is output from the external electrode 14*b*. Since the main line M is electromagnetically coupled with the sub-lines S1 and S2, a signal having power proportional to power of the signal output from the external electrode 14*b* is output from the external electrode 14*c*.

Figure 2:
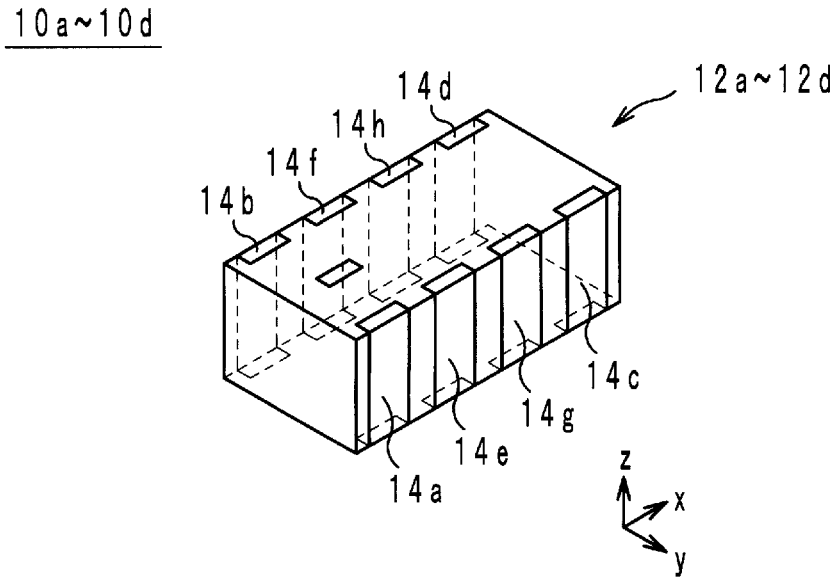
FIG. 2 is an external perspective view of the directional couplers according to the first through fourth embodiments of the present invention.
Figure 3A:
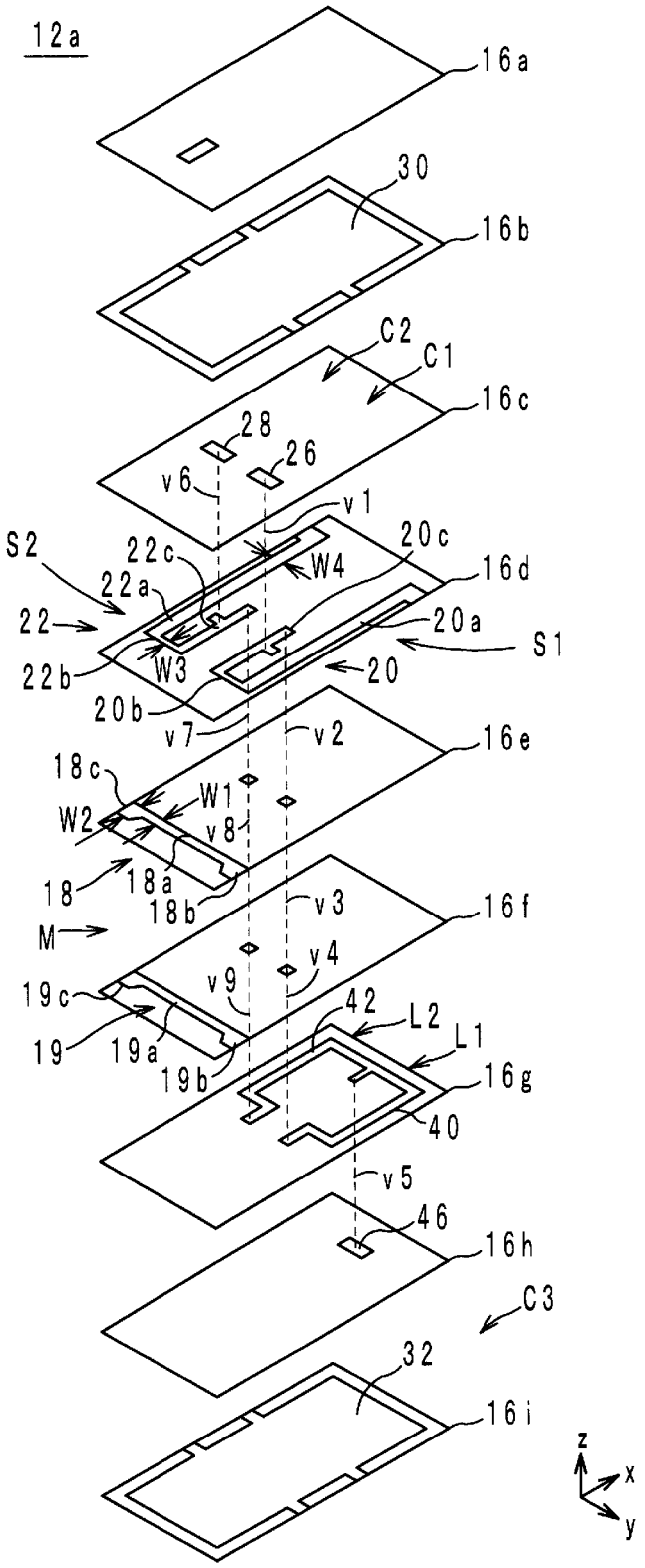
FIG. 3A is an exploded perspective view of a laminate body of the directional coupler according to the first embodiment.
Figure 3B:
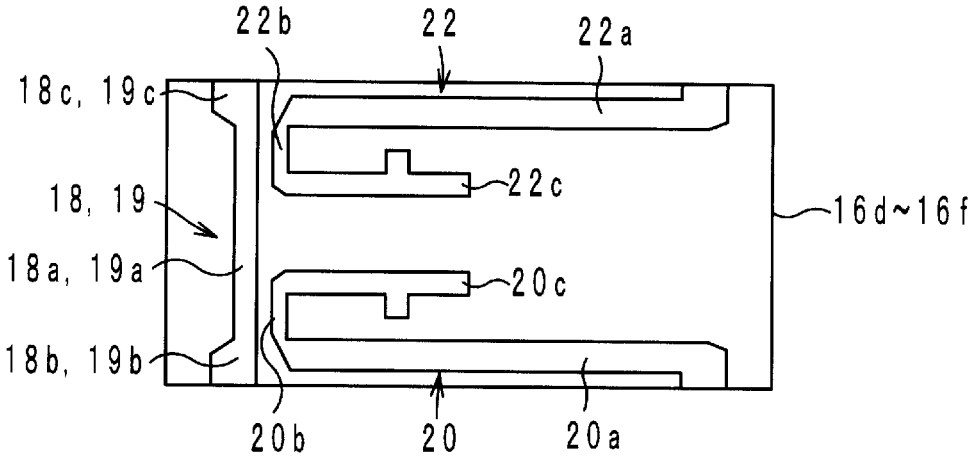
FIG. 3B shows the line portions of the laminate body in FIG. 3A stacked together.

The structure of the directional coupler 10*a* is specifically described with reference to the drawings. FIG. 2 is an external perspective view of the directional couplers 10*a* through 10*d* of the first through fourth embodiments of the present invention. FIG. 3A is an exploded perspective view of a laminate body 12*a* of the directional coupler 10*a* of the first embodiment. FIG. 3B illustrates line portions 18, 19, 20, and 22 in the laminated state thereof. In the discussion that follows, a z-axis direction is defined as the direction of lamination, an x-axis direction is defined as the direction along the long side of the directional coupler 10*a* in a plan view from the z-axis direction, and a y-axis direction is defined as the direction along the short side of the directional coupler 10*a* in a plan view from the z-axis direction. The x axis, the y axis and the z axis are mutually perpendicular to each other.

As illustrated in FIG. 2 and FIG. 3A, the directional coupler 10*a* includes the laminate body 12*a*, the external electrodes 14*a* through 14*h*, the main line M, the sub-lines S1 and S2, the low-pass filter LPF, and via hole conductors v1 through v9. As illustrated in FIG. 2, the laminate body 12*a* is a rectangular parallelepiped. As illustrated in FIG. 3A, the laminate body 12*a* is constructed by laminating insulation layers 16*a* through 16*i* successively along the z axis from a positive direction to a negative direction of the z axis. The plane of the laminate body 12*a* in the negative direction of the z axis is a mounting surface that is engaged with a circuit board when the directional coupler 10*a* is mounted on the circuit board. The insulation layers 16*a* through 16*i* are manufactured of dielectric ceramic, and are rectangular in shape.

The external electrodes 14*a*, 14*e*, 14*g*, and 14*c* are disposed on the side surface of the laminate body 12*a* on the positive side in the y axis direction in that order from the negative side to the positive side in the x axis direction. The external electrodes 14*b*, 14*f*, 14*h*, and 14*d* are disposed on the side surface of the laminate body 12*a* on the negative side in the y axis direction in that order from the negative side to the positive side in the x axis direction.

The main line M includes line portions 18 and 19 as illustrated in FIG. 3A. The line portions 18 and 19 are linear conductor layers and are disposed on different insulation layers 16*e* and 16*f* near short sides of the insulation layers 16*e* and 16*f* on the negative side of the x axis direction and extend in the y axis direction. The line portions 18 and 19 are symmetrical with respect to a center line of the insulation layers 16*e* and 16*f* passing at the center of the y axis direction and extending along the x axis direction. The line portions 18 and 19 are identical in shape, and are laminated in alignment in a plan view from the z axis direction.

The line portion 18 includes segments 18*a* through 18*c*. The segment 18*b* is an end portion of the line portion 18 on the positive side of the y axis direction and the segment 18*c* is an end portion of the line portion 18 on the negative side of the y axis direction. The segment 18*a* is a portion between the segments 18*b* and 18*c*. The line portion 19 includes segments 19*a* through 19*c*. The segment 19*b* is an end portion of the line portion 19 on the positive side of the y axis direction and the segment 19*c* is an end portion of the line portion 19 on the negative side of the y axis direction. The segment 19*a* is a portion between the segments 19*b* and 19*c*.

The end portions on the positive side of the y axis direction as the segments 18*b* and 19*b* are connected to the external electrode 14*a*, and the end portions on the negative side of the y axis direction as the segments 18*c* and 19*c* are connected to the external electrode 14*b*. The line portions 18 and 19 are thus connected in parallel between the external electrodes 14*a* and 14*b*. In this way, the main line M linearly directly connects the external electrode 14*a* to the external electrode 14*b*.

As illustrated in FIG. 3A, the sub-line S1 includes a line portion 20, and is a letter U-shaped conductor disposed on the insulation layer 16*d* as illustrated in FIG. 3A. More in detail, the line portion 20 includes segments 20*a* through 20*c*. The segment 20*a* extends in the x axis direction along the long side of the insulation layer 16*d* on the positive side of the y axis direction. The end portion of the segment 20*a* on the positive side of the x axis direction is connected to the external electrode 14*c*. As illustrated in FIG. 3B, the segment 20*b*, in a plan view from the z axis direction, extends in the y axis direction so that the segment 20*b* runs in parallel with the segments 18*a* and 19*a* of the line portions 18 and 19 along the positive side of the y axis direction from the center of the y axis direction. In this way, the sub-line S1 is electromagnetically coupled with the main line M. However, the main line M and the sub-line S1 have no overlap portion therebetween in a plan view from the z axis direction. The end portion of the segment 20*b* on the positive side of the y axis direction is connected to the end portion of the segment 20*a* on the positive side of the x axis direction. The end portion of the segment 20*b* the on the positive side of the y axis direction (in other words, the end portion of the segment 20*b* closer to the external electrode 14*a*) is located more negative side of the y axis direction (in other words, spaced more apart from the outline of the insulation layers 16*d* through 16*f*) than the end portions of the segments 18*a* and 19*a* on the positive side of the y axis direction (in other words, the end portions closer to the external electrode 14*a*). The segment 20*c* is disposed on more negative side of the y axis direction than the segment 20*a* and extends in the x axis direction. The end portion of the segment 20*c* on the negative side of the x axis direction is connected to the end portion of the segment 20*b* on the negative side of the y axis direction.

The sub-line S2 includes a line portion 22, and is a letter U-shaped conductor disposed on the insulation layer 16*d* as illustrated in FIG. 3A. The sub-line S2 is symmetrical with the sub-line S1 with respect to a line, passing in perpendicular to the y axis direction through the center of the insulation layer 16*d*. More in detail, the line portion 22 includes segments 22*a* through 22*c*. The segment 22*a* extends in the x axis direction along the long side of the insulation layer 16*d* on the negative side of the y axis direction. The end portion of the segment 22*a* on the positive side of the x axis direction is connected to the external electrode 14*d*. As illustrated in FIG. 3B, the segment 22*b*, in a plan view from the z axis direction, extends in the y axis direction so that the segment 22*b* runs in parallel with the segments 18*a* and 19*a* of the line portions 18 and 19 along the negative side of the y axis direction from the center of the y axis direction. In this way, the sub-line S2 is electromagnetically coupled with the main line M. However, the main line M and the sub-line S2 have no overlap portion therebetween in a plan view from the z axis direction. The end portion of the segment 22*b* on the negative side of the y axis direction is connected to the end portion of the segment 22*a* on the positive side of the x axis direction. The end portion of the segment 22*b* on the negative side of the y axis direction (in other words, the end portion of the segment 22*b* closer to the external electrode 14*b*) is located more positive side of the y axis direction (in other words, spaced more apart from the outline of the insulation layers 16*d* through 16*f*) than the end portions of the segments 18*a* and 19*a* on the negative side of the y axis direction (in other words, the end portions closer to the external electrode 14*b*). The segment 22*c* is disposed on more positive side of the y axis direction than the segment 22*a* and extends in the x axis direction. The end portion of the segment 22*c* on the negative side of the x axis direction is connected to the end portion of the segment 22*b* on the positive side of the y axis direction.

A line width W1 of the segments 18*a* and 19*a* of the main line M running in parallel with the sub-lines S1 and S2 is larger than a line width W3 of the segments 20*b* and 22*b* of the sub-lines S1 and S2 running in parallel with the main line M. A line width W2 of the segments 18*b*, 18*c*, 19*b*, and 19*c* of the main line M running in non-parallel with the sub-lines S1 and S2 is larger than the line width W1 of the segments 18*a* and 19*a* of the main line M running in parallel with the sub-lines S1 and S2. A line width W4 of the segments 20*a*, 20*c*, 22*a*, and 22*c* of the sub-lines S1 and S2 running in non-parallel with the main line M is larger than the line width W3 of the segments 20*b* and 22*b* of the sub-lines S1 and S2 running in parallel with the main line M. Increasing the line width reduces a direct current resistance, leading to a decrease in the loss of the main line M and the sub-lines S1 and S2.

The low-pass filter LPF includes the coils L1 and L2 and the capacitors C1 through C3. The coils L1 and L2 and the capacitors C1 through C3 are manufactured of conductive layers disposed on an insulation layer different from the insulation layer 16*d* supporting the sub-lines S1 and S2. More specifically, the coil L1 includes a line portion 40. The line portion 40 is disposed on the insulation layer 16*g*, and is a line conductive layer half-circularly counterclockwise extending in a plan view from the z axis direction. In the following discussion, an end portion of an upstream side of the line portion 40 in the counterclockwise extension is referred to as an upstream end, and an end portion of a downstream side of the line portion 40 in the counterclockwise extension is referred to as a downstream end. The upstream end of the line portion 40 overlaps the end portion of the segment 20*c* on the positive side of the x axis direction in a plan view from the z axis direction.

The via hole conductors v2 through v4 respectively penetrate the insulation layers 16*d* through 16*f* in the z axis direction, and are connected to each other, thereby functioning as a single via hole conductor. The via hole conductor v2 is connected to the end portion of the segment 20*c* on the positive side of the x axis direction. The via hole conductor v4 is connected to the upstream end of the line portion 40.

The coil L2 includes a line portion 42. The line portion 42 is disposed on the insulation layer 16*g*, and is a line conductive layer half-circularly clockwise extending in a plan view from the z axis direction. In the following discussion, an end portion of an upstream side of the line portion 42 in the clockwise extension is referred to as an upstream end, and an end portion of a downstream side of the line portion 42 in the clockwise extension is referred to as a downstream end. The downstream end of the line portion 40 and the downstream end of the line portion 42 are connected together. The upstream end of the line portion 42 overlaps the end portion of the segment 22*c* on the positive side of the x axis direction in a plan view from the z axis direction.

Via hole conductors v7 through v9 respectively penetrate the insulation layers 16*d* through 16*f* in the z axis direction, and are connected to each other, thereby functioning as a single via hole conductor. The via hole conductor v7 is connected to the end portion of the segment 22*c* on the positive side of the x axis direction. The via hole conductor v9 is connected to the upstream end of the line portion 42.

The capacitor C1 includes a capacitor conductor 26 and a ground conductor 30. The capacitor conductor 26 having a rectangular shape is disposed on the insulation layer 16*c*. The capacitor conductor 26 overlaps an area of the segment 20*c* close to the end portion the segment 20*c* on the positive side of the x axis direction in a plan view from the z axis direction. The ground conductor 30 is disposed on the insulation layer 16*b*, and generally covers the surface of the insulation layer 16*b*. The ground conductor 30 is opposed to the capacitor conductor 26 with the insulation layer 16*b* interposed therebetween. In this way, a capacitor is created between the capacitor conductor 26 and the ground conductor 30. The ground conductor 30 is connected to the external electrodes 14*e* through 14*h*.

The via hole conductor v1 penetrates the insulation layer 16*c* in the z axis direction and connects the capacitor conductor 26 to the area of the segment 20*c* close to the end portion of the segment 20*c* on the positive side of the x axis direction. In this way, the capacitor C1 is connected between the end portion of the sub-line S1 and the external electrodes 14*e* through 14*h*.

The capacitor C2 includes a capacitor conductor 28 and the ground conductor 30. The capacitor conductor 28 having a rectangular shape is disposed on the insulation layer 16*c*. The capacitor conductor 28 overlaps an area of the segment 22*c* close to the end portion of the segment 22*c* on the positive side of the x axis direction in a plan view from the z axis direction. The ground conductor 30 is disposed on the insulation layer 16*b*, and generally covers the surface of the insulation layer 16*b*. The ground conductor 30 is opposed to the capacitor conductor 28 with the insulation layer 16*b* interposed therebetween. In this way, a capacitor is created between the capacitor conductor 28 and the ground conductor 30.

The via hole conductor v6 penetrates the insulation layer 16*c* in the z axis direction and connects the capacitor conductor 28 to the area of the segment 22*c* close to the end portion of the segment 22*c* on the positive side of the x axis direction. In this way, the capacitor C2 is connected between the end portion of the sub-line S2 and the external electrodes 14*e* through 14*h*.

The capacitor C3 includes a capacitor conductor 46 and a ground conductor 32. The capacitor conductor 46 having a rectangular shape is disposed on the insulation layer 16*h*. The capacitor conductor 46 overlaps the downstream ends of the line portions 40 and 42 in a plan view from the z axis direction. The ground conductor 32 is disposed on the insulation layer 16*i*, and generally covers the surface of the insulation layer 16*i*. The ground conductor 32 is opposed to the capacitor conductor 46 with the insulation layer 16*h* interposed therebetween. In this way, a capacitor is created between the capacitor conductor 46 and the ground conductor 32. The ground conductor 32 is connected to the external electrodes 14*e* through 14*h*.

The via hole conductor v5 penetrates the insulation layer 16*g* in the z axis direction and connects the capacitor conductor 46 to the downstream end of the line portions 40 and 42. In this way, the capacitor C3 is connected between the junction of the coil L1 and the coil L2 and the external electrodes 14*e* through 14*h*.

The directional coupler 10*a* of the present embodiment provides an excellent directivity. More specifically, the directional coupler disclosed in Japanese Unexamined Patent Application Publication No. 2013-5076 includes the main line and the sub-line with the planes thereof opposed to each other, and has a stronger capacitive coupling. As a result, the odd mode appears stronger than the even mode on the directional coupler. Since the signals Sig 3 and Sig 4 travel in mutually opposite directions, the odd mode stronger than the even mode makes it difficult to achieve a desired directivity.

Figure 18:
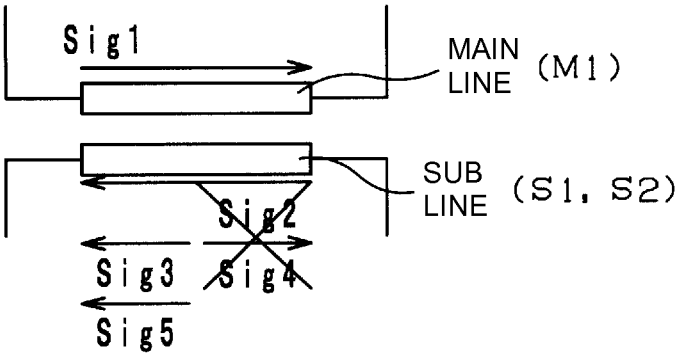
FIG. 18 illustrates the flow of a signal in the directional coupler.

The directional coupler 10*a* includes the main line M and the sub-lines S1 and S2 which do not overlap each other in a plan view from the z axis direction. The directional coupler 10*a* thus restricts the generation of the odd mode in contrast with the directional coupler disclosed in Japanese Unexamined Patent Application Publication No. 2013-5076. As illustrated in FIG. 18, part of the signal Sig 2 and the signal Sig 4 cancel each other in the sub-lines S1 and S2. As a result, the signal Sig 1 flows in the direction opposite to the direction of the signal Sig 5 in the sub-lines S1 and S2. In the directional coupler 10*a*, no signal is output from the external electrode 14*d* but a signal is output from the external electrode 14*c*. The directional coupler 10*a* thus provides an excellent directivity.

The main line M and the sub-lines S1 and S2 are disposed on the different insulation layers in the directional coupler 10*a*. This arrangement allows the insulation layer 16*d* to be interposed between the main line M and the sub-lines S1 and S2. A voltage created between the main line M and the sub-lines S1 and S2 controls the generation of ion migration.

The directional coupler 10*a* also provides improved transmission characteristics. The transmission characteristics are a ratio of the intensity value of a signal output from the external electrode 14*b* to the intensity value of a signal input to the external electrode 14*a*. The main line M and the sub-lines S1 and S2 do not overlap each other in a plan view from the z axis direction in the directional coupler 10*a*. For this reason, even if the line width of the main line M is increased, there is almost no increase in the capacitance formed between the main line M and the sub-lines S1 and S2. The directivity of the directional coupler 10*a* is not degraded in large amount. The increase in the line width of the main line M reduces a direct current resistance value of the main line M. As a result, the transmission characteristics of the directional coupler 10*a* are thus improved.

The main line M includes the line portions 18 and 19 connected in parallel in the directional coupler 10*a*. This arrangement reduces the direct current resistance value of the main line M. As a result, the transmission characteristics of the directional coupler 10*a* are improved further.

In the directional coupler 10*a*, the main line M has a line-symmetric structure, and also the sub-lines S1 and S2 are line-symmetric with each other. This arrangement provides the same characteristics regardless of whether the directional coupler 10*a* operates with the external electrode 14*b* serving as an input port, the external electrode 14*a* serving as an output port, the external electrode 14*d* serving as a coupling port, and the external electrode 14*c* serving as a termination port, or the directional coupler 10*a* operates with the external electrode 14*a* serving as an input port, the external electrode 14*b* serving as an output port, the external electrode 14*c* serving as a coupling port, and the external electrode 14*d* serving as a termination port.

The end portion of the segment 20*b* on the positive side of the y axis direction is located on more negative side in the y axis direction than the end portions of the segments 18*a* and 19*a* on the positive side of the y axis direction. This arrangement allows the segments 18*b* and 19*b* of the line portions 18 and 19 not contributing to the coupling with the line portion 20 to be shorter. Similarly, the end portion of the segment 22*b* on the negative side of the y axis direction is located on more positive side of the y axis direction than the end portions of the segments 18*a* and 19*a* on the negative side of the y axis direction. This arrangement allows the segments 18*c* and 19*c* of the line portions 18 and 19 not contributing to the coupling with the line portion 22 to be shorter. The segments 18*a*, 18*b*, 19*a*, and 19*b* of the line portions 18 and 19 not contributing to the coupling with the line portions 20 and 22 are shortened, and direct current resistance is reduced. The direct current resistance values of the segments 18*a*, 18*b*, 19*a*, and 19*b* are reduced. Note that the segments 18*a*, 18*b*, 19*a*, and 19*b* are shortened while the segments 20*a* and 22*b* are lengthened. The sub-lines S1 and S2 have a higher priority on coupling than on resistance value. An increase in the direct current resistance value of the line portions 20 and 22 caused by the lengthened segments 20 and 22 is not problematic.

As described below, the directional coupler 10*a* has amplitude characteristics of a coupling signal close to a flat pattern. More specifically, the directional coupler 10*a* includes the low-pass filter LPF between the sub-line S1 and the sub-line S2. The low-pass filter LPF includes a coil, and a capacitor or a transmission line. The low-pass filter LPF thus causes on a signal passing therethrough (passing signal) a phase shift having an absolute value that monotonously increases within a range of from about 0 degrees or higher to about 180 degrees or lower as the passing frequency increases within a predetermined frequency band. The directional coupler 10*a* thus has the amplitude characteristics of the signal output from the coupling port (the external electrode 14*c*) close to a flat pattern.

Modifications

Figure 4:
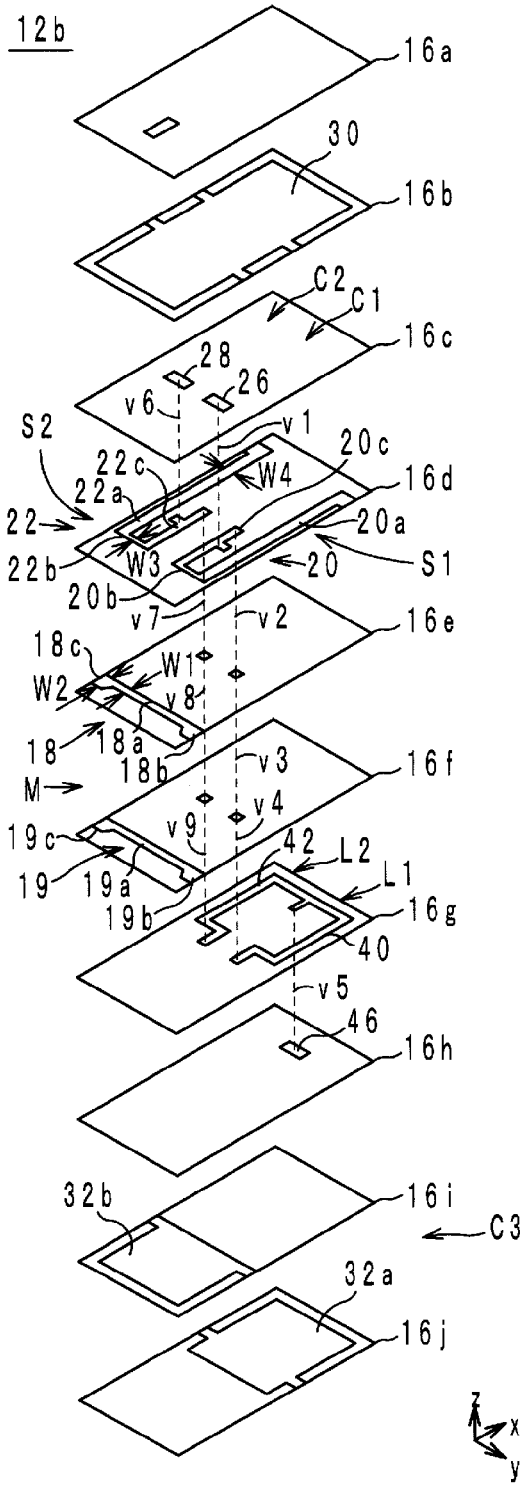
FIG. 4 is an exploded perspective view of the laminate body of a directional coupler according to a modified embodiment of the present invention.

A directional coupler 10*b* as a modification is described below with reference to the drawings. FIG. 4 illustrates a laminate body 12*b* of the directional coupler 10*b* of the modification. Refer to FIG. 2 for the external perspective view of the directional coupler 10*b*.

The directional coupler 10*b* is different from the directional coupler 10*a* in that the ground conductor 32 is divided into ground conductors 32*a* and 32*b*. The following discussion of the directional coupler 10*b* focuses on this difference.

The laminate body 12*b* is constructed by laminating insulation layers 16*a* through 16*j* successively in the z axis from a positive direction to a negative direction of the z axis direction. The ground conductor 32*a* covers about half of the top surface of the insulation layer 16*j* on the positive side of the x axis direction. The ground conductor 32*a* is opposed to the capacitor conductor 46, thereby forming the capacitor C3. The ground conductor 32*a* is opposed to the line portions 40 and 42 as the coils L1 and L2.

The ground conductor 32*b* is disposed on the insulation layer 16*i* different from the insulation layer 16*j* supporting the ground conductor 32*a*. The ground conductor 32*b* covers about half of the top surface of the insulation layer 16*i* on the negative side of the x axis direction. The ground conductor 32*b* is opposed to the line portion 19 as the main line M.

In the directional coupler 10*b* thus constructed, the ground conductor 32*a* opposed to the line portions 40 and 42 and the ground conductor 32*b* opposed to the line portion 19 are disposed different insulation layers, namely, the insulation layer 16*i* and the insulation layer 16*j*. This arrangement allows the spacing between the line portions 40 and 42 and the ground conductor 32*a* and the spacing between the line portion 19 and the ground conductor 32*b* to be adjusted independently. The capacitance formed between the line portions 40 and 42 and the ground conductor 32*a* and the capacitance formed between the line portion 19 and the ground conductor 32*b* may be adjusted independently. As a result, the characteristic impedance of the main line M and the characteristic impedance of the sub-lines S1 and S2 may be independently adjusted.

The inventor of this invention conducted the following test to clarify the advantageous effects of the directional couplers 10*a* and 10*b*.

Figure 9:
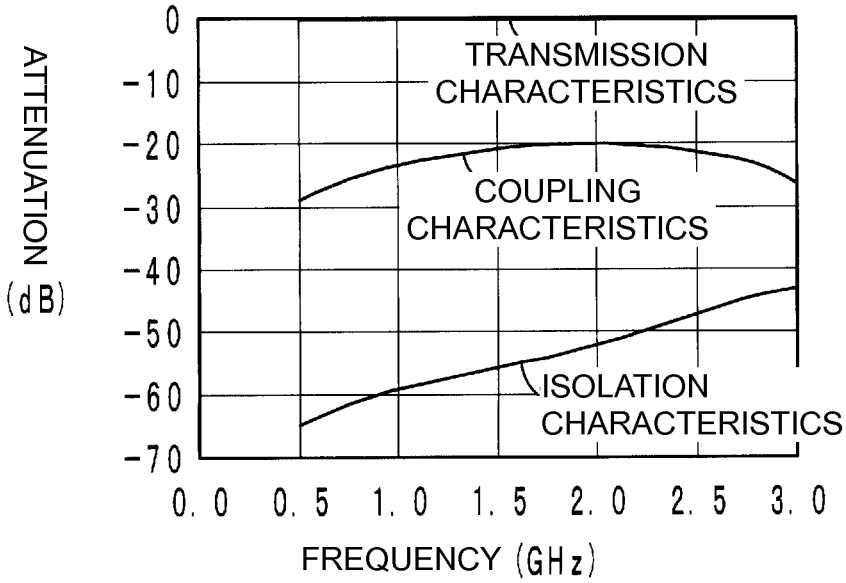
FIG. 9 is a graph representing simulation results of a first model.

The inventor manufactured as a first sample the directional coupler 10*b* having the structure of FIG. 4, and as a second sample the directional coupler having the structure of FIG. 9 disclosed in Japanese Unexamined Patent Application Publication No. 2013-5076. Specifications common to the first and second samples are listed below.

Size: 4.5 mm×3.2 mm×1.5 mm

Coupling characteristics in 2 GHz band: −20 dB

Isolation characteristics in 2 GHz band: −57 dB

Directivity in 2 GHz band: −37 dB

Figure 5:
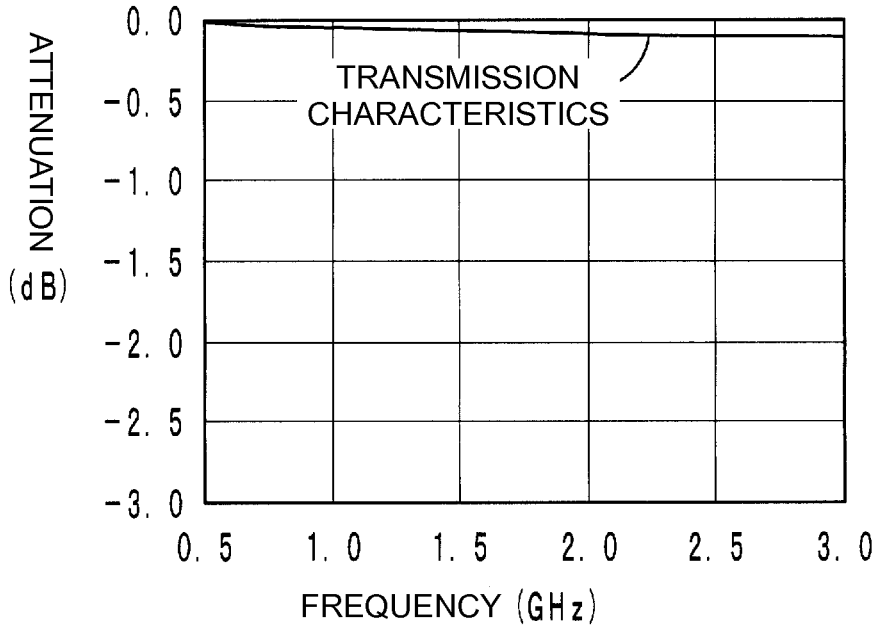
FIG. 5 is a graph representing transmission characteristics of a first sample.
Figure 6:
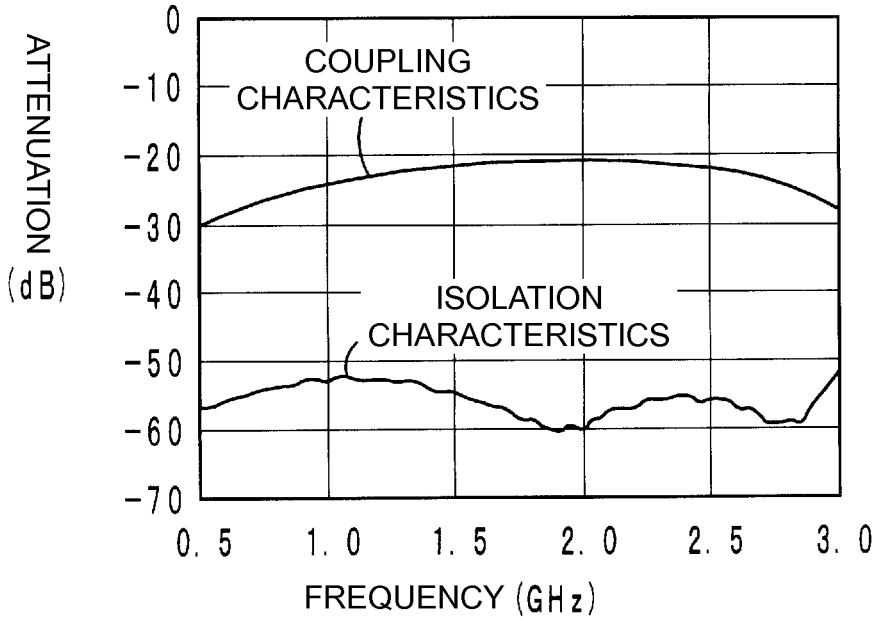
FIG. 6 is a graph representing coupling characteristics and isolation characteristics of the first sample.
Figure 7:
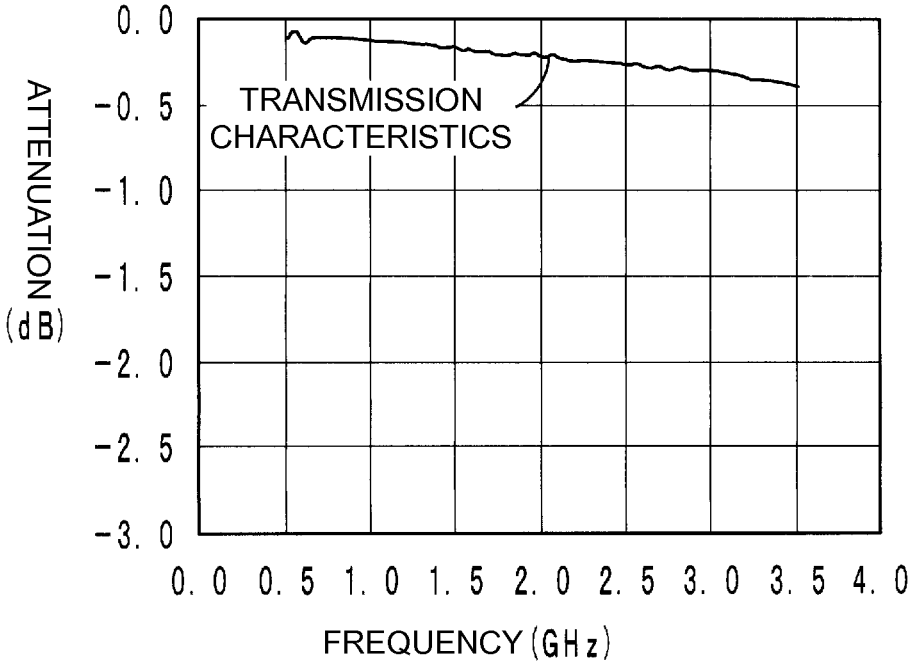
FIG. 7 is a graph representing transmission characteristics of a second sample.
Figure 8:
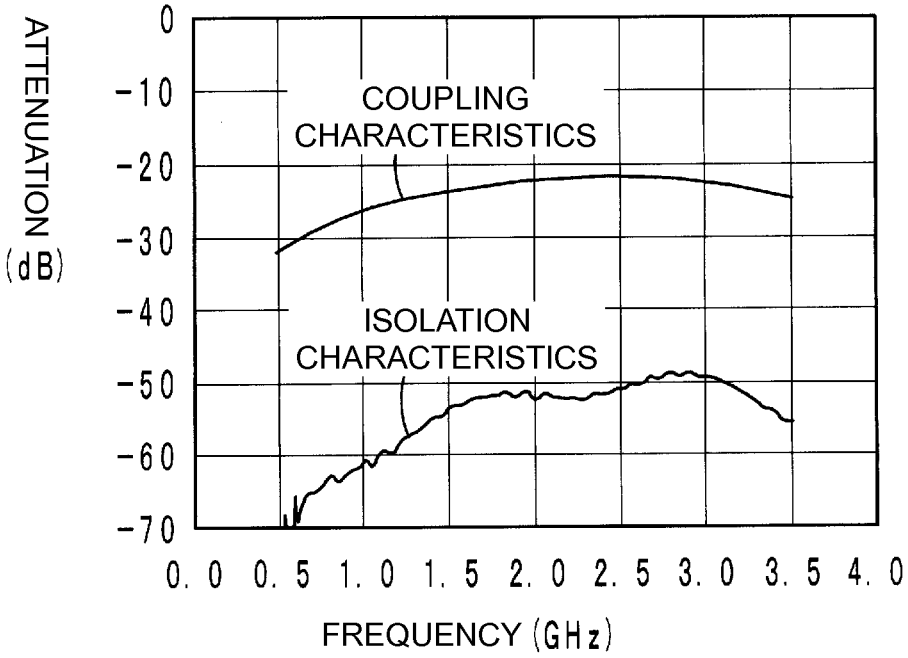
FIG. 8 is a graph representing coupling characteristics and isolation characteristics of the second sample.

FIG. 5 is a graph illustrating transmission characteristics of the first sample. FIG. 6 is a graph illustrating coupling characteristics and isolation characteristics of the first sample. FIG. 7 is a graph illustrating transmission characteristics of the second sample. FIG. 8 is a graph illustrating coupling characteristics and isolation characteristics of the second sample. In each graph, the ordinate represents attenuation, and the abscissa represents frequency.

The transmission characteristics are a ratio of the intensity value of a signal output from the output port (the external electrode 14*b*) to the intensity value of a signal input to the input port (the external electrode 14*a*). The coupling characteristics are a ratio of the intensity value of a signal output from the coupling port (the external electrode 14*c*) to the intensity value of the signal input to the input port (the external electrode 14*a*). The isolation characteristics are a ratio of the intensity value of a signal output from the termination port (the external electrode 14*d*) to the intensity value of the signal input to the input port (the external electrode 14*a*).

Better transmission characteristics mean that attenuation is closer to 0 dB in the graphs of FIG. 5 and FIG. 7. Better coupling characteristics mean that attenuation is closer to 0 dB in the graphs of FIG. 6 and FIG. 8. Better isolation characteristics mean that attenuation is farther from 0 dB in the graphs of FIG. 6 and FIG. 8.

As illustrated in FIG. 8, the line width of the main line M and the like in the second sample is designed so that the coupling characteristics on 2 GHz approaches −20 dB. More specifically, the line width of the main line M is decreased in the second sample to reduce the capacitance formed between the main line M and the sub-lines S1 and S2. In the second sample, however, the direct current resistance value of the main line M increases, degrading the transmission characteristics as illustrated in FIG. 7.

Since the main line M and the sub-lines S1 and S2 are opposed to each other in the direction of lamination in the second sample, a relatively large capacitance is created between the main line and the sub-lines. For this reason, the second sample has a stronger odd mode, leading to a degraded directivity. The directivity refers to a ratio of the intensity of a signal output from the termination port to the intensity of a signal output from the coupling port. The degraded directivity means degraded coupling characteristics or degraded isolation characteristics. The second sample has degraded isolation characteristics as illustrated in FIG. 8.

The first sample designed to have the coupling characteristics as high as −20 dB on 2 GHz is better in the transmission characteristics than the second sample as illustrated in FIG. 5. According the test results, the first sample provides the better transmission characteristics than the second sample.

The first sample and second sample have the coupling characteristics as high as about −20 dB on 2 GHz. As illustrated in FIG. 6, however, the first sample provides the better isolation characteristics than the second sample. If the coupling characteristics and the transmission characteristics are better, the directivity is also better. According to the test results, the first sample is better in directivity than the second sample.

The inventor of the invention performed computer simulation to determine appropriate spacing between the segments 18*a* and 19*a* and the segments 20*b* and 22*b* in a plan view from the z axis direction. First through fifth models were created in the computer simulation.

Specifications of the First Model

Structure of the first model: directional coupler 10*b* of FIG. 4

Line width of the segments 18*a* and 19*a:* 75 μm

Line width of the segments 22*b* and 22*c:* 50 μm

Spacing between the segments 18*a* and 19*a* and the segments 20*b* and 22*b* in a plan view from the z axis direction: 100 μm Spacing between the segments 18*a* and 19*a* and the segments 20*b* and 22*b* in the z axis direction: 25 μm Dielectric constant of the insulation layer: 6.8

Specifications of the Second Model

Structure of the second model: directional coupler 10*b* of FIG. 4

Line width of the segments 18*a* and 19*a:* 75 μm

Line width of the segments 22*b* and 22*c:* 50 μm

Spacing between the segments 18*a* and 19*a* and the segments 20*b* and 22*b* in a plan view from the z axis direction: 150 μm Spacing between the segments 18*a* and 19*a* and the segments 20*b* and 22*b* in the z axis direction: 25 μm Dielectric constant of the insulation layer: 6.8

Specifications of the Third Model

Structure of the third model: directional coupler 10*b* of FIG. 4

Line width of the segments 18*a* and 19*a:* 75 μm

Line width of the segments 22*b* and 22*c:* 50 μm

Spacing between the segments 18*a* and 19*a* and the segments 20*b* and 22*b* in a plan view from the z axis direction: 50 μm Spacing between the segments 18*a* and 19*a* and the segments 20*b* and 22*b* in the z axis direction: 25 μm Dielectric constant of the insulation layer: 6.8

Specifications of the Fourth Model

Structure of the fourth model: directional coupler 10*b* of FIG. 4

Line width of the segments 18*a* and 19*a:* 75 μm

Line width of the segments 20*b* and 22*b:* 50 μm

Spacing between the segments 18*a* and 19*a* and the segments 20*b* and 22*b* in a plan view from the z axis direction: 50 μm Spacing between the segments 18*a* and 19*a* and the segments 20*b* and 22*b* in the z axis direction: 100 μm Dielectric constant of the insulation layer: 6.8

Specifications of the Fifth Model

Structure of the fifth model: directional coupler 10*b* of FIG. 4 with the line portion 19 removed therefrom Line width of the segments 18*a* and 19*a:* 75 μm Line width of the segments 22*b* and 22*c:* 50 μm Spacing between the segments 18*a* and 19*a* and the segments 20*b* and 22*b* in a plan view from the z axis direction: 100 μm Spacing between the segments 18*a* and 19*a* and the segments 20*b* and 22*b* in the z axis direction: 25 μm Dielectric constant of the insulation layer: 6.8

Figure 10:
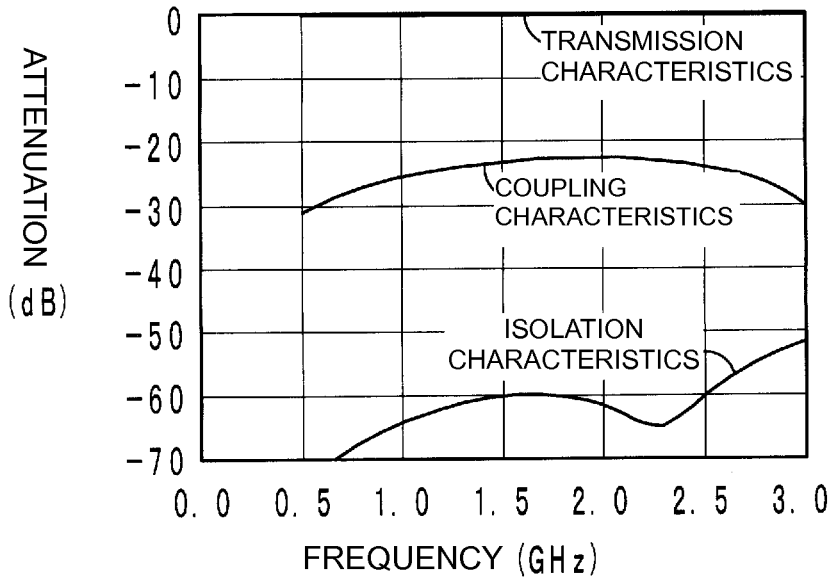
FIG. 10 is a graph representing simulation results of a second model.
Figure 11:
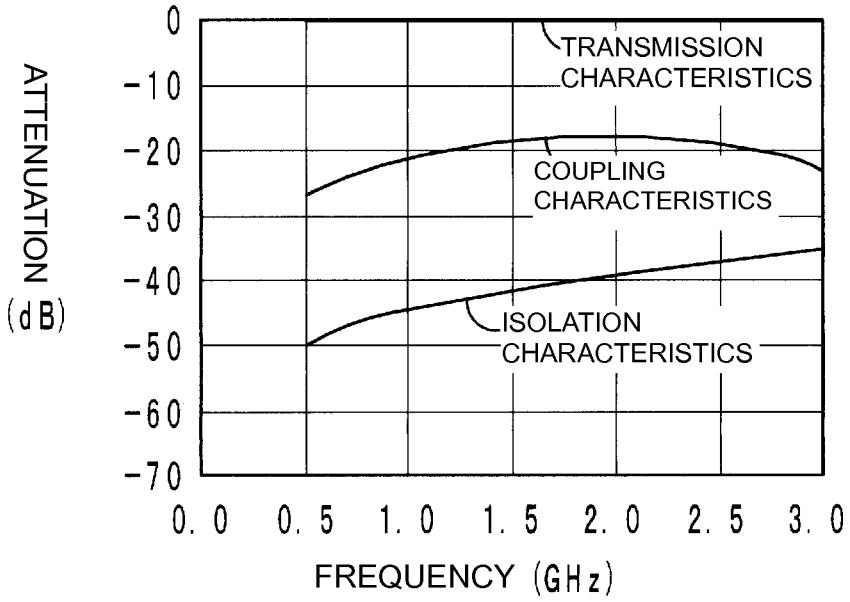
FIG. 11 is a graph representing simulation results of a third model.
Figure 12:
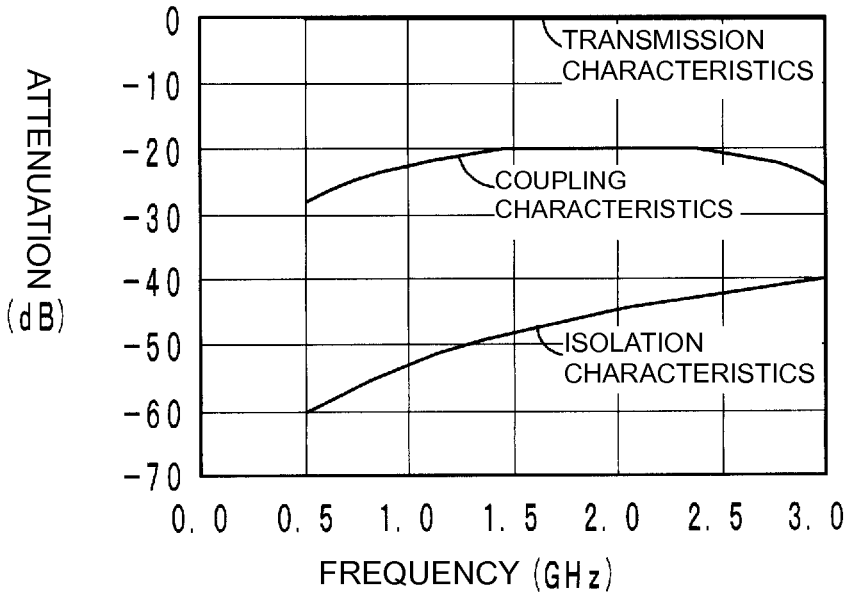
FIG. 12 is a graph representing simulation results of a fourth model.
Figure 13:
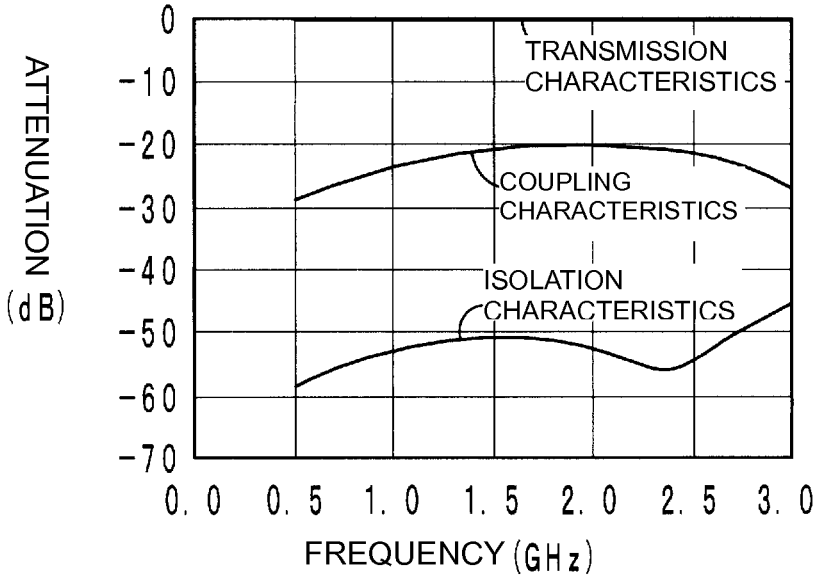
FIG. 13 is a graph representing simulation results of a fifth model.

The transmission characteristics, the coupling characteristics, and the isolation characteristics are calculated using the first through fifth models. FIG. 9 is a graph illustrating the simulation results of the first model. FIG. 10 is a graph representing the simulation results of the second model. FIG. 11 is a graph representing the simulation results of the third model. FIG. 12 is a graph representing the simulation results of the fourth model. FIG. 13 is a graph representing the simulation results of the fifth model. In each graph, the ordinate represents attenuation, and the abscissa represents frequency.

By comparison of the simulation results of the first model with the simulation results of the second model with reference to FIG. 9 and FIG. 10, the first model has coupling characteristics of about −20 dB on 2 GHz while the second model has a larger attenuation value than −20 dB. As a result, the second model has smaller coupling characteristics. It is considered that the spacing between the segments 18*a* and 19*a* and the segments 20*b* and 22*b* in a plan view from the z axis direction is too large in the second model.

By comparison of the simulation results of the first model with the simulation results of the third model with reference to FIG. 9 and FIG. 11, the first model has coupling characteristics of about −20 dB on 2 GHz while the third model has a smaller attenuation value than −20 dB. As a result, the third model has larger coupling characteristics. It is considered that the spacing between the segments 18*a* and 19*a* and the segments 20*b* and 22*b* in a plan view from the z axis direction is too small in the third model. From the above results, the spacing between the segments 18*a* and 19*a* and the segments 20*b* and 22*b* in a plan view from the z axis direction is desirably as large as about 100 μm.

The simulation results of the fourth model are now studied. By comparison of the simulation results of the third model with the simulation results of the fourth model with reference to FIG. 11 and FIG. 12, the third model has isolation characteristics of about −39 dB on 2 GHz while the fourth model has isolation characteristics of about −45 dB on 2 GHz. The fourth model has a larger spacing between the segments 18*a* and 19*a* and the segments 20*b* and 22*b* in the z axis direction than the third model. However, since the fourth model, as the third model, has too small a spacing between the segments 18*a* and 19*a* and the segments 20*b* and 22*b* in a plan view from the z axis direction, a higher capacitance is created between the segments 18*a* and 19*a* and the segments 20*b* and 22*b*. For this reason, insufficient isolation characteristics result. If the spacing between the segments 18*a* and 19*a* and the segments 20*b* and 22*b* in a plan view from the z axis direction is too small, it is found difficult to achieve sufficient isolation characteristics even though the spacing between the segments 18*a* and 19*a* and the segments 20*b* and 22*b* is increased in the z axis direction.

The simulation results of the fifth model are now studied. Since the fifth model does not include the line portion 19, a direct current resistance value of the main line M is high. For this reason, the first model has transmission characteristics of −0.083 dB on 2 GHz while the fifth model has transmission characteristics of −0.093 dB on 2 GHz. This concludes that the line portion 18 and the line portion 19 are desirably connected in parallel.

Second Embodiment

Figure 14:
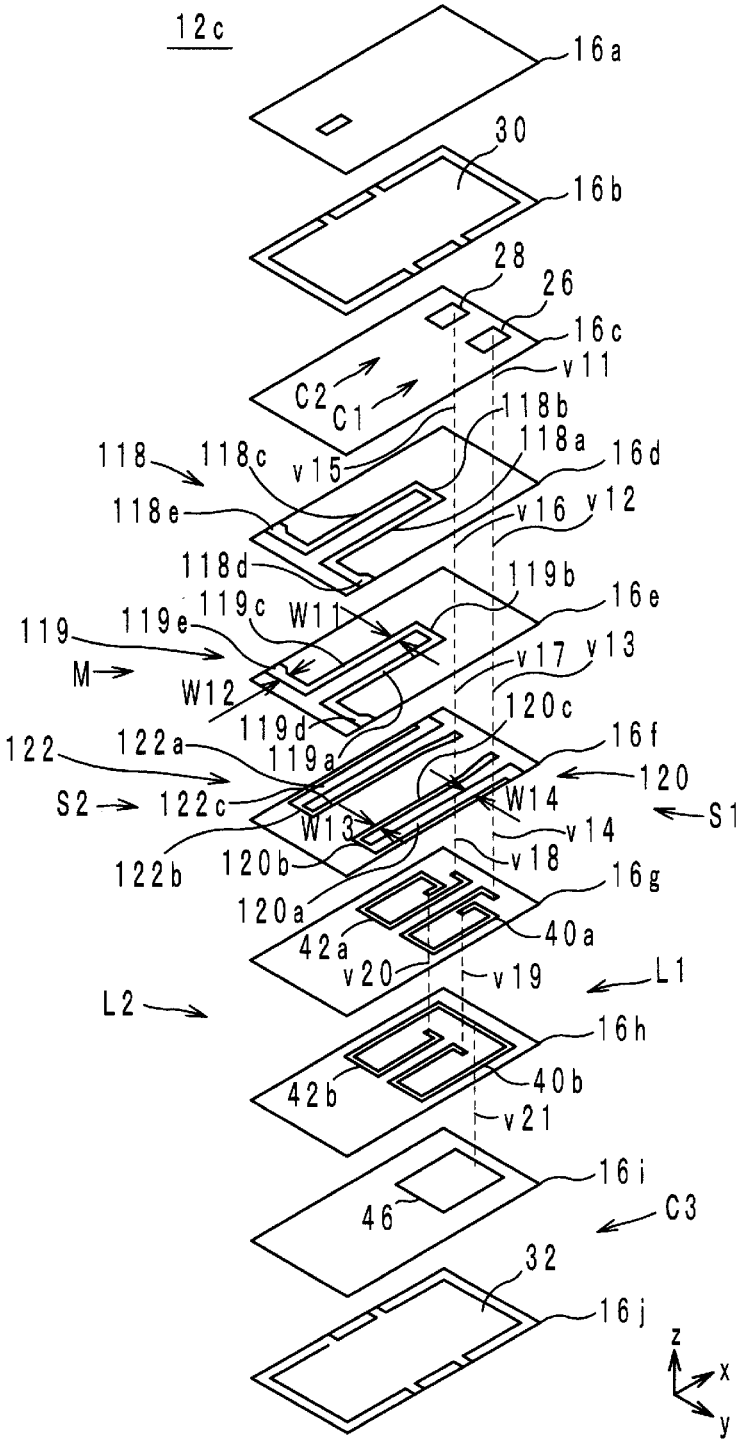
FIG. 14 is an exploded perspective view of a laminate body of the directional coupler according to the second embodiment of the present invention.

A specific structure of a directional coupler 10*c* of a second embodiment is described with reference to the drawings. FIG. 14 is an exploded perspective view of a laminate body 12*c* of the directional coupler 10*c* of the second embodiment. Reference is made to FIG. 2 for the external perspective view of the directional coupler 10*c*.

Referring to FIG. 2 and FIG. 14, the directional coupler 10*c* includes the laminate body 12*c*, external electrodes 14*a* through 14*h*, main line M, sub-lines S1 and S2, low-pass filter LPF, and via hole conductors vii through v18, and v21. The laminate body 12*c* and the external electrodes 14*a* through

14*h* in the directional coupler 10*c* are identical to the counterparts thereof in the directional coupler 10*a*, and the discussion thereof is omitted herein.

The main line M includes line portions 118 and 119 as illustrated in FIG. 14. The main line M has a line-symmetric structure with respect to a line passing in perpendicular to the y axis direction through the center of each of the insulation layers 16*d* and 16*e* in the x axis direction. The line portions 118 and 119 are disposed on different insulation layers 16*d* and 16*e*. The line portions 118 and 119 are identical in shape, and overlap in alignment in a plan view from the z axis direction.

The line portion 118 includes segments 118*a* through 118*e*. The segment 118*d* is an end portion of the line portion 118 on the positive side of the y axis direction, and the segment 118*e* is an end portion of the line portion 118 on the negative side of the y axis direction. The segments 118*a* through 118*c* are disposed between the segments 118*d* and 118*e*. The segment 118*a* is connected to an end portion of the segment 118*d* on the negative side of the y axis direction, and extends along the positive side of the x axis direction. The segment 118*c* is connected to an end portion of the segment 118*e* on the positive side of the y axis direction and extends along the positive side of the x axis direction. The segment 118*b* extends in the y axis direction and connects an end portion of the segment 118*a* on the positive side of the x axis direction to an end portion of the segment 118*c* on the positive portion of the x axis direction.

The line portion 119 includes the segments 119*a* through 119*e*. The segment 119*d* is an end portion of the line portion 119 on the positive side of the y axis direction, and the segment 119*e* is an end portion of the line portion 119 on the negative side of the y axis direction. The segments 119*a* through 119*c* are disposed between the segments 119*d* and 119*e*. The segment 119*a* is connected to an end portion of the segment 119*d* on the negative side of the y axis direction, and extends along the positive side of the x axis direction. The segment 119*c* is connected to an end portion of the segment 119*e* on the positive side of the y axis direction and extends along the positive side of the x axis direction. The segment 119*b* extends in the y axis direction and connects an end portion of the segment 119*a* on the positive side of the x axis direction to an end portion of the segment 119*c* on the positive portion of the x axis direction.

End portions of the segments 118*d* and 119*d* on the positive side on the y axis direction are connected to the external electrode 14*a*, and end portions of the segments 118*e* and 119*e* on the negative side of the y axis direction are connected to the external electrode 14*b*. The line portions 118 and 119 are thus connected in parallel between the external electrodes 14*a* and 14*b*.

The sub-line S1 includes a line portion 120, and is a letter U-shaped linear conductor disposed on the insulation layer 16*f* as illustrated in FIG. 14. More in detail, the line portion 120 includes segments 120*a* through 120*c*. The segment 120*a* extends in the x axis direction along the long side of the insulation layer 16*f* on the positive side of the y axis direction. The end portion of the segment 120*a* on the positive side of the x axis direction is connected to the external electrode 14*c*. The segment 120*b* is connected to an end portion of the segment 120*a* on the negative side of the x axis direction and extends in the negative direction of the y axis. The segment 120*c* is connected to an end portion of the segment 120*b* on the negative side of the y axis direction and extends in the x axis direction in parallel with the segments 118*a* and 119*a* of the line portion 118 and the line portion 119 in a plan view from the z axis direction. The sub-line S1 is thus electromagnetically coupled with the main line M. Note that the main line M and the sub-line S1 do not overlap each other in a plan view from the z axis direction.

The sub-line S2 includes a line portion 122, and is a letter U-shaped linear conductor disposed on the insulation layer 16*f* as illustrated in FIG. 14. More in detail, the line portion 122 includes segments 122*a* through 122*c*. The segment 122*a* extends in the x axis direction along the long side of the insulation layer 16*f* on the negative side of the y axis direction. The end portion of the segment 122*a* on the positive side of the x axis direction is connected to the external electrode 14*d*. The segment 122*b* is connected to an end portion of the segment 122*a* on the negative side of the x axis direction and extends in the positive direction of the y axis. The segment 122*c* is connected to an end portion of the segment 122*b* on the positive side of the y axis direction and extends in the x axis direction in parallel with the segments 118*a* and 119*a* of the line portion 118 and the line portion 119 in a plan view from the z axis direction. The sub-line S2 is thus electromagnetically coupled with the main line M. Note that the main line M and the sub-line S2 do not overlap each other in a plan view from the z axis direction.

A line width W11 of the segments 118*a*, 118*c*, 119*a*, and 119*c* of the main line M running in parallel with the sub-lines S1 and S2 is larger than a line width W13 of the segments 120*c* and 122*c* of the sub-lines S1 and S2 running in parallel with the main line M. A line width W12 of the segments 118*b*, 118*d*, 118*e*, 119*b*, 119*d*, and 119*e* of the main line M running in non-parallel with the sub-lines S1 and S2 is larger than the line width W11 of the segments 118*a*, 118*c*, 119*a*, and 119*c* of the main line M running in parallel with the sub-lines S1 and S2. A line width W14 of the segments 120*a*, 120*b*, 122*a*, and 122*b* of the sub-lines S1 and S2 running in non-parallel with the main line M is larger than the line width W13 of the segments 120*c* and 122*c* of the sub-lines S1 and S2 running in parallel with the main line M.

The low-pass filter LPF includes the coils L1 and L2 and the capacitors C1 through C3. The coils L1 and L2 and the capacitors C1 through C3 are manufactured of conductive layers disposed on insulation layers different from the insulation layer 16*f* supporting the sub-lines S1 and S2. More specifically, the coil L1 includes line portions 40*a* and 40*b*, and a via hole conductor v19. The line portion 40*a* is disposed on the insulation layer 16*g*, and is a line conductive layer almost circularly counterclockwise extending in a plan view from the z axis direction. In the following discussion, an end portion of an upstream side of the line portion 40*a* in the counterclockwise extension is referred to as an upstream end, and an end portion of a downstream side of the line portion 40*a* in the counterclockwise extension is referred to as a downstream end. The upstream end of the line portion 40*a* overlaps the end portion of the segment 120*c* on the positive side of the x axis direction in a plan view from the z axis direction.

The line portion 40*b* is disposed on the insulation layer 16*h*, and is a line conductive layer almost circularly counterclockwise extending in a plan view from the z axis direction. In the following discussion, an end portion of an upstream side of the line portion 40*b* in the counterclockwise extension is referred to as an upstream end, and an end portion of a downstream side of the line portion 40*b* in the counterclockwise extension is referred to as a downstream end. The upstream end of the line portion 40*b* overlaps the downstream end of the segment 40*a* in a plan view from the z axis direction.

The via hole conductor v19 connects the downstream end of the line portion 40*a* to the upstream end of the line portion 40*b*. A spiral coil L1 is thus formed.

The via hole conductor v14 penetrates the insulation layer 16*f* in the z axis direction, and connects the end portion of the segment 120*c* on the positive side of the x axis direction to the upstream end of the line portion 40*a*.

The coil L2 includes line portions 42*a* and 42*b*, and a via hole conductor v20. The line portion 42*a* is disposed on the insulation layer 16*g*, and is a line conductive layer almost circularly clockwise extending in a plan view from the z axis direction. In the following discussion, an end portion of an upstream side of the line portion 42*a* in the clockwise extension is referred to as an upstream end, and an end portion of a downstream side of the line portion 42*a* in the clockwise extension is referred to as a downstream end. The upstream end of the line portion 42*a* overlaps the end portion of the segment 122*c* on the positive side of the x axis direction in a plan view from the z axis direction.

The line portion 42*b* is disposed on the insulation layer 16*h*, and is a line conductive layer almost circularly clockwise extending in a plan view from the z axis direction. In the following discussion, an end portion of an upstream side of the line portion 42*b* in the clockwise extension is referred to as an upstream end, and an end portion of a downstream side of the line portion 42*b* in the clockwise extension is referred to as a downstream end. The upstream end of the line portion 42*b* overlaps the downstream end of the segment 42*a* in a plan view from the z axis direction.

The via hole conductor v20 connects the upstream end of the line portion 42*a* to the downstream end of the line portion 42*b*. A spiral coil L2 is thus formed.

The via hole conductor v18 penetrates the insulation layer 16*f* in the z axis direction, and connects the end portion of the segment 122*c* on the positive side of the x axis direction to the upstream end of the line portion 42*a*.

The capacitors C1 through C3 of the directional coupler 10*c* are identical in structure to the capacitors C1 through C3 in the directional coupler 10*a*, and the discussion thereof is omitted herein.

The line length where the main line M and the sub-lines S1 and S2 extend in parallel with each other in the directional coupler 10*c* is longer than the line length where the main line M and the sub-lines S1 and S2 extend in parallel with each other in the directional coupler 10*a*. The directional coupler 10*c* having a longer length where the main line M and the sub-lines S1 and S2 extend in parallel with each other works on a lower frequency band than the directional coupler 10*a*. For example, the directional coupler 10*a* is used on a frequency band in the vicinity of 2 GHz, while the directional coupler 10*c* is used on a frequency band in the vicinity of 1 GHz.

Modifications

Figure 15:
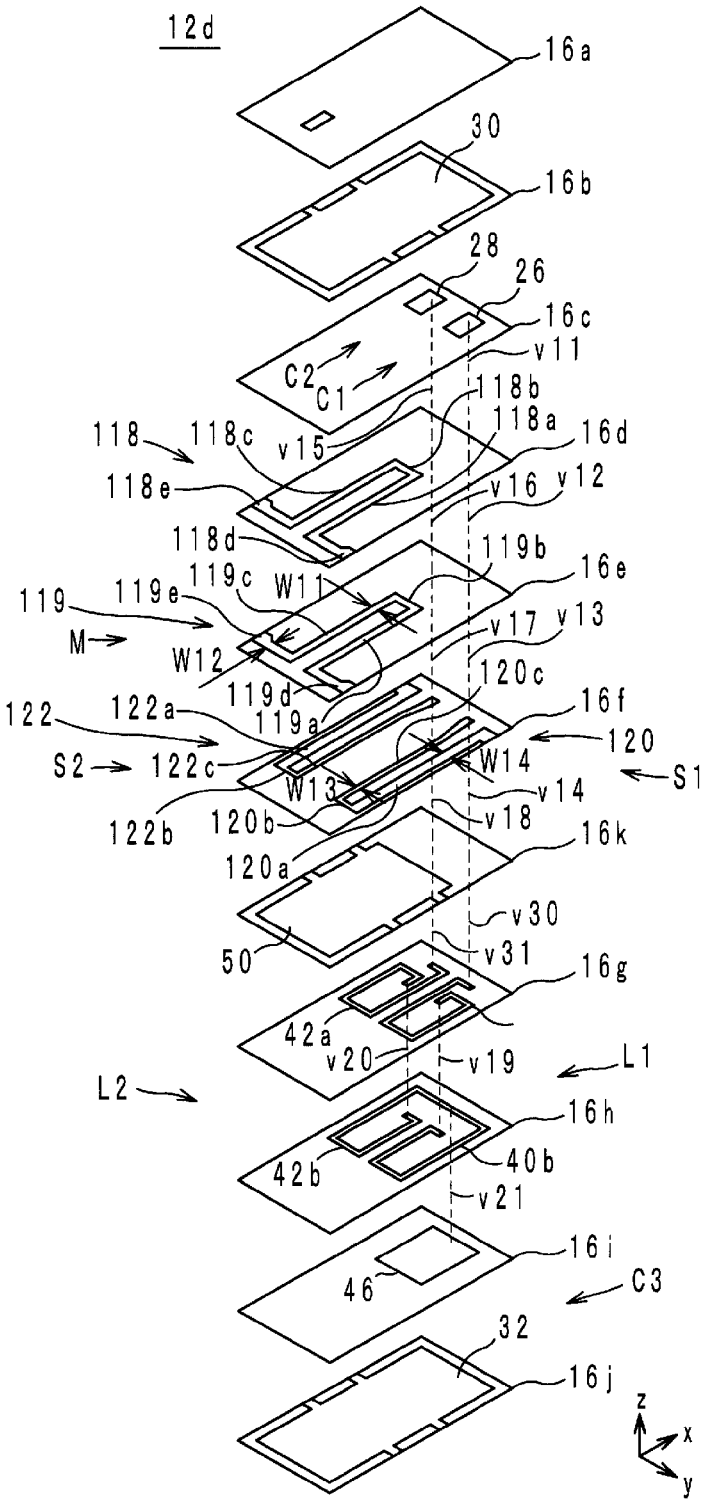
FIG. 15 is an exploded perspective view of the laminate body of the directional coupler according to a modified embodiment of the present invention.
Figure 16:
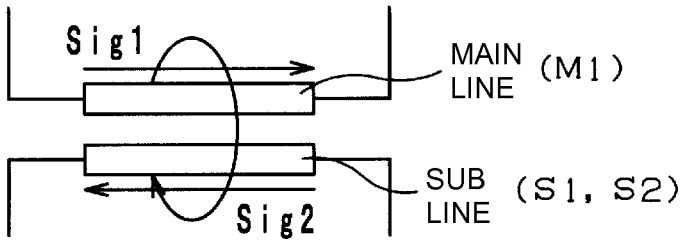
FIG. 16 illustrates the flow of a signal in the directional coupler.
Figure 17:
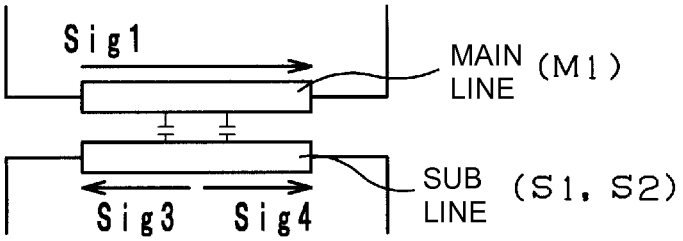
FIG. 17 illustrates the flow of a signal in the directional coupler.

A directional coupler 10*d* as a modification is described below with reference to the drawings. FIG. 15 is an exploded perspective view of a laminate body 12*d* of the directional coupler 10*d*.

The directional coupler 10*d* is different from the directional coupler 10*c* in that the directional coupler 10*d* includes a ground conductor 50. The discussion of the directional coupler 10*d* focuses on the difference.

The directional coupler 10*d* includes an insulation layer 16*k* between the insulation layer 16*f* and the insulation layer 16*g*. The ground conductor 50 is disposed on the insulation layer 16*k* and overlaps line portions 118, 119, 120, 122, 40*a*, 40*b*, 42*a*, and 42*b* in a plan view from the z axis direction. More specifically, the ground conductor 50 is disposed between the coils L1 and L2 and the main line M and sub-lines S1 and S2 in the z axis direction. However, the ground conductor 50 does not cover an area along the short side of the insulation layer 16*k* on the positive side of the x axis direction in order to connect the line portion 120 to the line portion 40*a* and in order to connect the line portion 122 to the line portion 42*a*. The ground conductor 50 is connected to the external electrodes 14*e* through 14*h*.

As described above, the directional coupler 10*d* thus constructed includes the ground conductor 50 between the coils L1 and L2 and the main line M and sub-lines S1 and S2 in the z axis direction. This arrangement restricts the creation of capacitance between the coils L1 and L2 and the main line M and sub-lines S1 and S2 in the z axis direction, thereby controlling a variation from a desired value of the characteristic impedance of the main line M and the sub-lines S1 and S2.

Other Modifications

The embodiments are not limited to the directional couplers 10*a* through 10*d*, and may be changed or modified with the scope of the present invention.

Not only the main line M but also the sub-lines S1 and S2 may include a plurality of line conductors connected in parallel. Since the characteristic impedance of the sub-lines S1 and S2 tends to vary, the sub-line desirably includes a smaller number of lines (more specifically, a smaller number of layers) than that of the main line M.

The structures of the directional couplers 10*a* through 10*d* may be combined.

The present invention is useful in the field of directional coupler, and is particularly advantageous in improving the directivity thereof.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A directional coupler for use in a predetermined frequency band, comprising:

a laminate body including a laminate of a plurality of insulation layers;

a first terminal through a fourth terminal disposed on a surface of the laminate body;

a main line connected between the first terminal and the second terminal and disposed on at least one of the insulation layers;

a first sub-line disposed on at least one of the insulation layers, connected to the third terminal, and electromagnetically coupled with the main line;

a second sub-line disposed on at least one of the insulation layers, connected to the fourth terminal, and electromagnetically coupled with the main line; and a phase adjusting circuit connected between the first sub-line and the second sub-line and configured to cause a phase shift in a passing signal, wherein the main line, the first sub-line and the second sub-line do not overlap each other in a plan view from a direction of lamination.

2. The directional coupler according to claim 1, wherein the phase adjusting circuit is a low-pass filter.

3. The directional coupler according to claim 2, wherein the main line is larger in line width than each of the first sub-line and the second sub-line.

4. The directional coupler according to claim 2, wherein the main line extends at least partially in parallel with the first sub-line and the second sub-line, and wherein a segment of the main line that extends not in parallel with the first sub-line and the second sub-line is larger in line width than a segment of the main line that extends in parallel with the first sub-line and the second sub-line.

5. The directional coupler according to claim 2, wherein the main line extends at least partially in parallel with the first sub-line and the second sub-line, and wherein a segment of the first sub-line or the second sub-line that extends not in parallel with the main line is larger in line width than a segment of the first sub-line or the second sub-line that extends in parallel with the main line.

6. The directional coupler according to claim 2, wherein the main line extends at least partially in parallel with the first sub-line, and wherein the segment of the first sub-line extending in parallel with the main line has end portions, and one of the end portions closer to the third terminal is spaced more apart from an outer periphery of the insulation layer than one of end portions closer to the first terminal.

7. The directional coupler according to claim 2, wherein the low-pass filter comprises a conductive layer, and the conductive layer is disposed on at least one of the insulation layers different from at least one of the insulation layers on which the first sub-line is disposed and at least one of the insulation layers on which the second sub-line is disposed.

8. The directional coupler according to claim 2, wherein the main line comprises a plurality of conductive layers, and the plurality of conductive layers are connected in parallel to each other and disposed on different insulation layers among the plurality of insulation layers.

9. The directional coupler according to claim 2, wherein the main line linearly connects the first terminal to the second terminal.

10. The directional coupler according to claim 2, wherein the low-pass filter comprises:

a coil disposed on at least one of the insulation layers; and a capacitor including a capacitor conductor connected to the coil, and a ground conductor that is opposed to the capacitor conductor and is disposed in the direction of lamination between the coil, and the main line, the first sub-line and the second sub-line.

11. The directional coupler according to claim 2, wherein the low-pass filter comprises:

a coil disposed on the insulation layer; and a capacitor including a capacitor conductor connected to the coil, and a first ground conductor that is disposed on at least one of the insulation layers and is opposed to the capacitor conductor, wherein the directional coupler further comprises a second ground conductor disposed on at least one of the insulation layers different from at least one of the insulation layer on which the first ground conductor is disposed.

12. The directional coupler according to claim 2, wherein the low-pass filter causes in the passing signal the phase shift having an absolute value that increases monotonously within a range of about 0 degree or higher to about 180 degrees or lower as a frequency of the passing signal increases in the predetermined frequency band.

13. The directional coupler according to claim 2, wherein the first terminal is an input terminal configured to receive a first signal, wherein the second terminal is a first output terminal configured to output the first signal therefrom, wherein the third terminal is a second output terminal configured to output a second signal having power proportional to power of the first signal, and wherein the fourth terminal is a termination terminal.

* * * * *

UNITED STATES PATENT AND TRADEMARK OFFICE

CERTIFICATE OF CORRECTION

PATENT NO. : 9,000,864 B2
APPLICATION NO. : 14/251875
DATED : April 7, 2015
INVENTOR(S) : Tanaka It is certified that error appears in the above-identified patent and that said Letters Patent is hereby corrected as shown below:

In the specification,

Column 12, line 66, replace “vii” with --v11--

Signed and Sealed this
Fifteenth Day of September, 2015

Michelle K. Lee

Michelle K. Lee
*Director of the United States Patent and Trademark Office*